US005377395A

United States Patent [19]

Maier et al.

[11] Patent Number: 5,377,395

[45] Date of Patent: Jan. 3, 1995

[54] EXTERNALLY REMOVABLE CASKET HARDWARE

[75] Inventors: Donald R. Maier, Cincinnati, Ohio; John E. Linville, Osgood, Ind.

[73] Assignee: Batesville Casket Company, Inc., Batesville, Ind.

[21] Appl. No.: 57,655

[22] Filed: May 4, 1993

[51] Int. Cl.[6] ..... A61G 17/04

[52] U.S. Cl. ..... 27/2; 27/27; 116/112; 411/366; 411/433

[58] Field of Search ..... 27/1, 27, 35, 2; 16/114 R, 112; 411/433, 395, 366

[56] References Cited

U.S. PATENT DOCUMENTS

| | | | |
|---|---|---|---|
| 385,707 | 7/1888 | Gould et al. . | |
| 1,185,655 | 6/1916 | Govro . | |
| 1,227,929 | 5/1917 | Ralston . | |
| 1,581,096 | 4/1926 | Barnes | 411/395 |
| 1,779,488 | 5/1929 | Patterson . | |
| 1,979,854 | 7/1933 | Beck . | |
| 3,204,286 | 9/1965 | Hillenbrand | 16/112 |
| 4,077,096 | 3/1978 | Christian | 27/2 |
| 4,237,590 | 12/1980 | Work . | |
| 4,462,731 | 7/1984 | Rovinsky et al. | 411/433 |
| 4,615,085 | 10/1986 | Hartman | 27/1 |
| 4,657,458 | 4/1987 | Woller et al. | 411/433 |
| 4,737,059 | 4/1988 | Batten | 411/433 |
| 5,008,990 | 4/1991 | Craft . | |
| 5,144,727 | 9/1992 | Craft . | |
| 5,169,400 | 12/1992 | Mühling et al. | 411/395 |
| 5,226,678 | 7/1993 | Petranto | 411/433 |

*Primary Examiner*—Lanna Mai
*Assistant Examiner*—Kien Nguyen
*Attorney, Agent, or Firm*—Wood, Herron & Evans

[57] ABSTRACT

An externally mounted removable hardware assembly for a casket having a threaded bolt extending through a hole in a casket side wall. Inside the casket, the bolt threadably engages a nut which is snap-fit within a retention can. The nut has a longitudinally threaded bore therein and is formed from complementary nut sections which mate. An ejector pin is slidably mounted in a longitudinal bore in the bolt. The ejector pin may be depressed from outside of the casket. The pin slides within the bolt bore and contacts the retention cap thereby forcing the retention cap off of the nut allowing the nut halves to fall apart. Once the nut is dislodged from the retention cap and the nut sections have split apart and separated from the bolt, the bolt is thereby freed to be removed from the casket through the hole in the casket exterior wall without opening of the casket.

22 Claims, 1 Drawing Sheet

EXTERNALLY REMOVABLE CASKET HARDWARE

FIELD OF THE INVENTION

This invention relates to a casket, and more particularly, to the mounting of external hardware on the casket.

BACKGROUND OF THE INVENTION

A hardwood casket frequently has externally mounted metal hardware. The metal hardware is both functional and ornamental in that it provides a secure mount for a handlebar which is used in lifting, transporting, and maneuvering the casket, i.e., by the pallbearers. Furthermore, the metal hardware offers an attractive and visually appealing contrast to the hardwood casket.

When hardwood caskets having standard metal hardware are cremated, the metal hardware is a source of problems. The external hardware on caskets are often die cast parts which include zinc as a major component. During cremation, the zinc in the metal hardware tends to damage and deteriorate the fire brick of the crematory. Furthermore, during the cremation process the melting and decomposition of the zinc can yield undesirable gases. As a result, the cremation industry is making attempts to eliminate the production of these gases during the cremation process.

The use of metal hardware on caskets presents other problems during cremation. During the cremation of caskets having metal hardware, incidental human remains such as bone fragments tend to sear and attach to the molten metal presenting disposal problems and thereby further complicating the cremation process. Specifically, external metal casket hardware which is stamped steel does not melt during the cremation process but does sear to bone fragments. Due to its mass, the stamped steel hardware is a nuisance to remove from the remains when it is still hot from the cremation process.

Additionally, the ornamental and functional metal hardware used on hardwood caskets can be expensive to manufacture and incorporate into the casket.

Complicating matters is the requirement that after the casket lid has been closed and locked, for example, subsequent to the memorial service, the casket may not be unlocked and the lid opened to remove the external casket hardware by removing the fasteners which can only be accessed from the interior of the casket.

It is therefore desirable to have externally mounted metal casket hardware which is both attractive and functional but which does not present the problems currently associated with the cremation of caskets having the rather expensive metal hardware components.

SUMMARY OF THE INVENTION

It is among the principal objectives of the present invention to provide externally mountable metal casket hardware which can be completely removed subsequent to the memorial services and prior to the cremation process without opening the casket thereby eliminating introduction of metal hardware into the crematory entirely.

It has been a further objective to provide a mounting mechanism for external metal casket hardware which allows the hardware both to be removed prior to cremation and then re-used by re-attachment of the hardware on other caskets.

A further objective of the present invention has been to provide such externally removable metal casket hardware without sacrificing the strength and integrity of the hardware when mounted to the casket.

The foregoing objectives of the present invention have been obtained in accordance with a presently preferred embodiment of the invention by providing externally mounted metal casket hardware which is removable prior to cremation of the casket without opening of the casket. The externally mounted metal hardware includes a threaded bolt which projects through a hole in the wall of the wooden casket. The bolt threadably engages a nut on the interior side of the casket wall. The nut includes two complementary nut sections. Each nut section includes a longitudinal threaded trough. When the two nut sections are appropriately mated together, their interface surfaces are in contact, and the complementary troughs in each nut section cooperate to form the longitudinal threaded bore of the nut. When the two complementary nut sections are assembled together thereby forming the nut, the nut is snap-fitted into a retention cap socket. The nut bore is then aligned with the through hole in the casket wall and threaded onto the bolt attached to the metal hardware and projecting through the hole in the casket wall. Tightening of the nut on the bolt secures the hardware to the casket.

An ejector pin extends through a longitudinal bore in the bolt. The ejector pin has a head which is accessible on the exterior of the casket. The ejector pin is slidable within the longitudinal bolt bore and is longer than the bolt so that when the bolt is secured in the nut, the ejector pin head is spaced from the bolt head.

To remove the attached metal hardware from the casket, the ejector pin head is depressed with a screw driver or other suitable tool from the exterior side of the casket. When the ejector pin head is depressed, the opposite or terminal end of the ejector pin contacts the retention cap mounted in the casket. Continued inward movement of the ejector pin forces the retention cap off of the nut where it falls to the bottom of the casket. Once the retention cap is forced off the nut, the nut sections separate one from another thereby freeing the bolt. The bolt can then be withdrawn through the hole in the casket exterior wall thereby allowing removal of the metal hardware from the casket without opening of the casket. The retention cap and nut sections are preferably formed of plastic. Since they remain in the casket and are cremated therewith, the plastic material is readily destroyed. For example, the retention cap and nut sections may be fabricated from a glass filled acetal co-polymer which offers sufficient structural integrity to secure and support the metal hardware but is safely and efficiently burned in the crematory without: the hereinabove described disadvantages associated with metal and zinc components.

The metal hardware may then be re-used merely by attaching a new nut and retention cap to the hardware mounted on another casket.

DETAILED DESCRIPTION OF THE INVENTION

Figure 1:
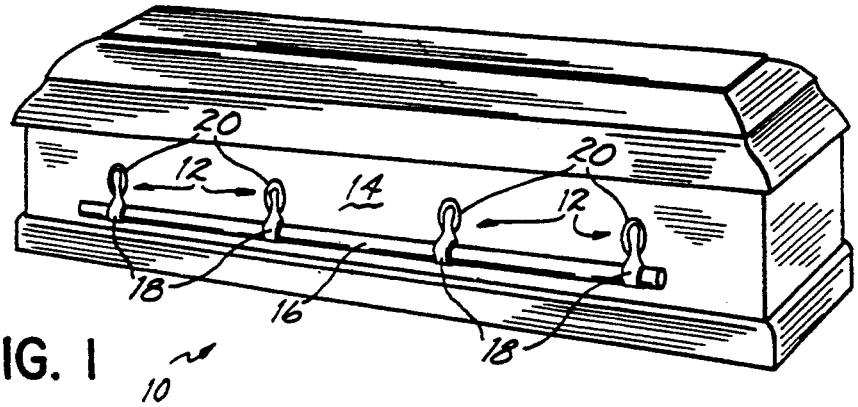
FIG. 1 is a perspective view of a casket having externally mounted metal hardware.

Referring to FIG. 1, a casket 10 has externally mounted hardware assemblies 12. The casket 10 has a side wall 14 to which the hardware assemblies 12 are mounted. The hardware assemblies 12 can take many forms, and the illustrated hardware assemblies are simply exemplary. FIG. 1 shows a bar 16 mounted along its length by a number of hardware assemblies 12, each including an arm 18 pivoted to a die cast escutcheon 20 mounted on the casket wall 14. A like hardware assembly is affixed to the opposite casket side wall as well.

Figure 2:
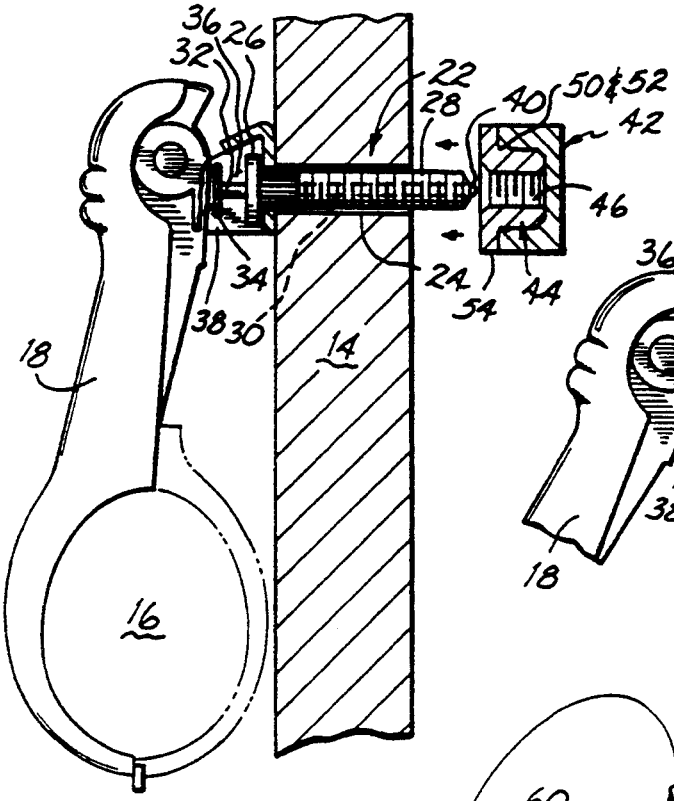
FIG. 2 is a side view of the hardware mounted to the side wall of a casket with the bolt attached to the metal hardware and projecting through the wall of the casket and the nut and retention cap being shown in cross-section.

Referring in addition to FIG. 2, the assembly 12 includes a bolt 22 which projects through a hole 24 in the casket wall 14. The bolt 22 has a head 26 and an elongated threaded shaft 28. The bolt 22 also has a longitudinally extending bore 30 which houses an ejector pin 32 slidably mounted therein. The ejector pin 32 has a head 34 which extends from the bolt bore 30 adjacent to the bolt head 26 and is positioned within a cavity 36 of the hardware assembly 12 having an opening 38 providing access thereto. In this manner, the ejector pin is concealed from view behind the arm 18. The ejector pin 32 also has a terminal end 40 spaced from the ejector pin head 34.

A retention cap 42 and a nut 44 are positioned within the casket 10 on the opposite side of the casket wall 14 from the hardware assembly 12. The nut 44 has a longitudinal threaded bore 46 therein adapted to receive the threaded bolt 22 and thereby securely mount the hardware assembly 12 on the casket 10 by tightening of the nut 44 on the bolt 22 against the side wall 14.

Figure 4:
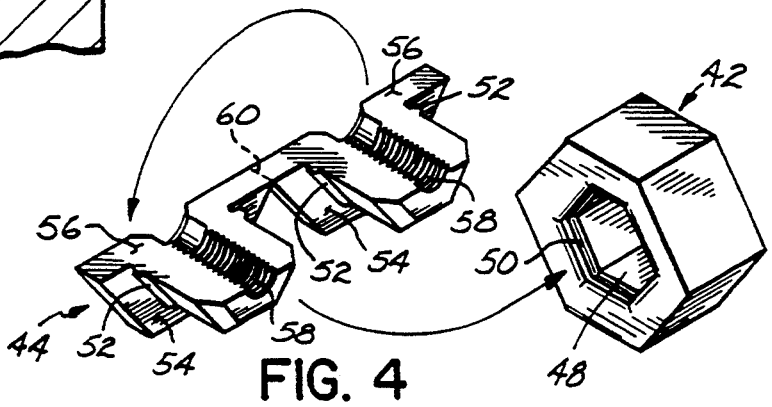
FIG. 4 is a perspective view of the nut sections and retention cap forming a part of the present invention.

A presently preferred embodiment of the retention cap 42 and nut 44 are shown in FIG. 4. The retention cap 42 has a hexagonal socket 48 into which the nut 44 is snap-fitted. In the preferred embodiment of the present invention the retention cap socket 48 has a groove 50 into which a detent 52 or lip on the nut 44 snap-fits for a secure interface between the retention cap 42 and nut 44.

The nut 44 has a hexagonal shape complementary to the shape of the retention cap socket 48 and is formed of a pair of complementary nut sections 54, 54. The nut sections 54, 54 cooperate by mating together to form the nut 44. Each nut section 54 has an interface surface 56 with a longitudinal threaded trough 58 therein. When the nut sections 54, 54 are brought together, the interface surfaces 56, 56 mate and the troughs 58, 58 in each nut section 54 cooperate form the threaded longitudinal bore 46 of the assembled nut 44. A living hinge 60 or other suitable mechanism is provided to join the nut sections 54, 54 to insure that complementary nut sections are used and to aid in the assembly of the nut 44.

Once the nut sections 54, 54 are assembled to form the nut 44, the nut 44 is then snap-fitted securely within the retention cap 42. In this regard, the detent 52 snaps into the groove 50 to hold the nut 44 within the cap 42. The nut 44 and retention cap 42 are then threaded onto the bolt 22 as shown in FIG. 2. The nut 44 is threaded onto bolt 22 until it contacts the side wall 14 of the casket 10 thereby securing the hardware assembly 12 attached to the bolt 22 onto the casket wall 14.

Figure 3:
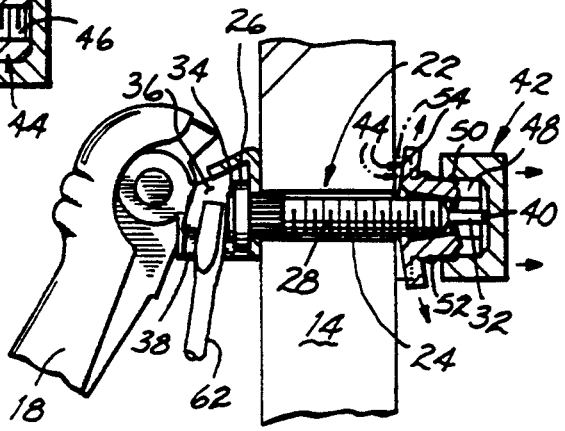
FIG. 3 is a partial cross-sectional view similar to FIG. 2 showing operation of the ejector pin within the bolt to dislodge the retention cap from the nut.

After the casket 10 is closed and locked and prior to cremation, the hardware assembly 12 may be removed from the casket 10. As shown in FIG. 3, a screwdriver 62 or other suitable tool is inserted behind the arm 18. The screwdriver 62 engages the head 34 of the ejector pin 32 and depresses the pin 32. As the ejector pin head 34 is depressed, the ejector pin 32 slides through the longitudinal bore 30 within tile bolt 22. The terminal end 40 comes into contact with the retention cap 42. Continued inward movement of the pin 32 snaps the retention cap 42 out of engagement with the nut 44. That is, the force placed on the ejector pin 32 by the screwdriver 62 is sufficient to snap the detent 52 out of the groove 50 in the cap 42 thereby releasing the nut 44 from the cap 42.

Once the retention cap is snapped off, it merely falls to the bottom of the casket. The nut 44, now unrestrained by the cap 42, easily separates into the nut sections 54, 54 and dislodges from the bolt 22. The nut sections 54, 54 also fall to the bottom of the casket. The bolt 22 and hardware assembly 12 are now removed from the casket 10 by withdrawing the bolt 22 from the hole 24 in the casket wall 14.

In this way, the hardware assembly 12 and bolt 22 may be constructed of metal and still avoid the problems associated with metal in the crematory as described hereinabove. Furthermore, even though the retention cap 42 and nut 44 remain within the casket 10 and are subjected to the cremation process; the retention cap 42 and nut 44 being fabricated from a plastic, such as glass filled acetal, are destroyed during cremation and therefore do not present the disadvantages and problems associated with the burning of metal in the crematory. Additionally, once removed from the casket the hardware assembly 12 may be economically installed on other caskets for repeated use.

In a presently preferred embodiment of the present invention the bolt 22 is a size 10 bolt with a major diameter of 0.19 inches having 24 threads per inch. Likewise, the threaded bore 46 of the nut 44 has a matching major diameter of 0.19 inches with 24 threads per inch. The bolt bore 30 extending longitudinally through the bolt 22 has a diameter of 0.09 inches and is of sufficient size to slidably mount the ejector pin 32 therein.

The bolt 22 is fabricated from 1018 steel to withstand the forces and structural loading demands normally encountered in the lifting, transporting, and maneuvering of caskets. Additionally, the glass filled acetal copolymer used in the presently preferred embodiment in fabricating the nut 44 and retention cap 42 has a tensile strength of approximately 16,000 psi at 73° F. and a flexural strength of approximately 23,000 psi at 5% deformation.

The nut sections 54, 54, as shown in FIG. 4, may be joined by a living hinge 60 which insures that two complementary nut sections are assembled together. However, it will be appreciated that any mechanism may be used which insures that two complementary nut sections are brought together. Further, the nut sections 54, 54 need not necessarily be joined at all. Rather the two sections may simply be snapped into the nut 42 and retained thereby.

Front the above disclosure of the general principles of the present invention and the preceding detailed description of the presently preferred embodiment, those skilled in the art will readily comprehend the various modifications to which the present invention is susceptible.

What is claimed is:

1. A fastener assembly for removably attaching hardware to a wall of a casket comprising:

an elongated externally threaded bolt adapted to project through a hole in the casket wall;

securement means for threadably engaging said bolt inside the cabinet to removably secure the hardware to the casket wall; and an ejector actuatable from outside the casket and operable upon actuation to force said securement means off said bolt such that said bolt may be withdrawn through the hole to detach the hardware from the casket without opening the casket.

2. A fastener assembly for removably attaching hardware to a wall of a casket comprising:

an elongated externally threaded bolt adapted to project through a hole in the casket wall;

securement means for threadably engaging said bolt to removably secure the hardware to the casket wall; and an ejector actuatable from outside the casket and operable upon actuation to force said securement means off said bolt such that said bolt may be withdrawn through the hole to detach the hardware from the casket without opening the casket;

wherein said bolt includes a longitudinal bore therethrough, and said ejector is a pin slidable mounted in said bolt longitudinal bore.

3. A fastener assembly for removably attaching hardware to a wall of a casket comprising:

an elongated externally threaded bolt adapted to project through a hole in the casket wall;

securement means for threadably engaging said bolt to removably secure the hardware to the casket wall; and an ejector actuatable from outside the casket and operable upon actuation to force said securement means off said bolt such that said bolt may be withdrawn through the hole to detach the hardware from the casket without opening the casket;

wherein said securement means comprises:

a retention cap; and complementary nut sections each having a threaded trough extending longitudinally along an interface surface thereof, said nut sections being adapted to mate to form a nut and be received in said retention cap, said threaded troughs cooperating to form a threaded nut bore when said nut sections are mated to form said nut, said nut being threadably engageable with said bolt extending through the casket wall to secure the hardware to the casket.

4. A fastener assembly for removably attaching hardware to a wall of a casket comprising:

an elongated externally threaded bolt adapted to project through a hole in the casket wall;

a retainer;

complementary nut sections each having a threaded trough extending longitudinally along an interface surface thereof, said nut sections being adapted to mate to form a nut and be received in said retainer, said threaded troughs cooperating to form a threaded nut bore when said nut sections are mated to form said nut, said nut being threadably engageable with said bolt extending through the casket wall interiorly to the casket to secure the hardware to the casket; and an ejector actuatable from outside the casket and operable upon actuation to force said retainer off said nut when said nut is threadably engaged with said bolt, thereby allowing said nut sections to dislodge from said bolt to free said bolt such that said bolt may be withdrawn through the hole to detach the hardware from the casket without opening the casket.

5. The fastener assembly of claim 4 wherein said bolt includes a longitudinal bore therethrough, and said ejector is a pin slidably mounted in said bolt longitudinal bore.

6. The fastener assembly of claim 4 further comprising:

a hinge joining said complementary nut sections together.

7. The fastener assembly of claim 4 further comprising:

means for insuring that said nut sections are complementary.

8. The fastener assembly of claim 4 wherein said retainer includes a socket and a groove around said socket, and said nut sections include a detent adapted to snap-fit within said groove to provide a secure fit between said nut sections and said retainer.

9. The fastener assembly of claim 4 wherein said nut and said retainer are each hexagonal shaped.

10. The fastener assembly of claim 4 wherein said nut sections and said retainer are each fabricated from glass filled acetal co-polymer.

11. A fastener assembly for removably attaching hardware to a wall of a casket comprising:

an elongated externally threaded bolt adapted to project through a hole in the casket wall, said bolt having a longitudinal bore therethrough;

a retention cap;

complementary nut sections each having a threaded trough extending longitudinally along an interface surface thereof, said nut sections being adapted to mate to form a nut and be received in said retention cap, said threaded troughs cooperating to form a threaded nut bore when said nut sections are mated to form said nut, said nut being threadably engageable with said bolt extending through the casket wall interiorly of the casket to secure the hardware to the casket; and an ejector pin slidably mounted in said longitudinal bore of said bolt and having an end exterior of the casket, said ejector pin being longer than said bolt whereby when said nut in said retention cap is threadably engaged on said bolt and said end of said ejector pin exterior of said casket is contacted, said ejector pin is depressed toward said nut and forces said retention cap off said nut, thereby allowing said nut sections to dislodge from said bolt to free said bolt such that said bolt may be withdrawn through the hole to detach the hardware from the casket without opening the casket.

12. The fastener assembly of claim 11 further comprising:

a hinge for joining said complementary nut sections together.

13. The fastener assembly of claim 11 further comprising:

means for insuring that said nut sections are complementary.

14. The fastener assembly of claim 11 wherein said retention cap includes a socket anti a groove around said socket, and said nut sections include a detent adapted to snap-fit within said groove to provide a secure fit between said nut sections and said retention cap.

15. The fastener assembly of claim 11 wherein said nut sections and said retention cap are each fabricated from glass filled acetal co-polymer.

16. The fastener assembly of claim 11 wherein said nut, said socket and said retention cap are each hexagonal shaped.

17. A combination comprising:

a casket having a wall;

hardware for removable attachment to said wall; and a fastener assembly for removably attaching said hardware to said casket wall, said fastener assembly comprising:

a.) an elongated externally threaded bolt adapted to project through a hole in said casket wall;

b.) securement means for threadably engaging said bolt to removably secure said hardware to said casket wall; and c.) an ejector actuatable from outside said casket and operable on actuation to force said securement means off said bolt such that said hardware may be detached from said casket without opening said casket.

18. The combination of claim 17 wherein said bolt includes a longitudinal bore therethrough, and said ejector is a pin slidably mounted in said bolt longitudinal bore.

19. The combination of claim 17 wherein said securement means comprises:

a retention cap; and complementary nut sections each having a threaded trough extending longitudinally along an interface surface thereof, said nut sections being adapted to mate to form a nut and be received in said retention cap, said threaded troughs cooperating to form a threaded nut bore when said nut sections are mated to form said nut, said nut being threadably engageable with said bolt extending through said casket wall to secure said hardware to said casket.

20. A combination comprising:

a casket having a wall;

hardware for removable attachment to said casket wall; and a fastener assembly for removably attaching said hardware to said casket wall, said fastener assembly comprising:

a.) an elongated externally threaded bolt adapted to project through a hole in said casket wall:

b.) a retainer;

c.) complementary nut sections each having a threaded trough extending longitudinally along an interface surface thereof, said nut sections being adapted to mate to form a nut and be received in said retainer, said threaded troughs cooperating to form a threaded nut bore when said nut sections are mated to form said nut, said nut being threadably engageable with said bolt extending through said casket wall interiorly of said casket to secure said hardware to said casket; and d.) an ejector actuatable from outside said casket and operable upon actuation to force said retainer off said nut when said nut is threadably engaged with said bolt thereby allowing said nut sections to dislodge from said bolt to free said bolt such that said bolt may be withdrawn through said hole to detach said hardware from said casket without opening said casket.

21. A combination comprising:

a casket having a wall;

hardware for removable attachment to said casket wall; and a fastener assembly for removably attaching said hardware to said casket wall, said fastener assembly comprising:

a.) an elongated externally threaded bolt adapted to project through a hole in said casket wall, said bolt having a longitudinal bore therethrough;

b.) a retention cap;

c.) complementary nut sections each having a threaded trough extending longitudinally along a surface thereof, said nut sections being adapted to mate to form a nut and be received in said retention cap, said threaded troughs cooperating to form a threaded nut bore when said nut sections are mated to form said nut, said nut being threadably engageable with said bolt extending through said casket wall interiorly of said casket to secure said hardware to said casket; and d.) an ejector pin slidably mounted in said longitudinal bore of said bolt and having an end exterior of said casket, said ejector pin being longer than said bolt whereby when said nut in said retention cap is threadably engaged on said bolt and said end of said ejector pin exterior of said casket is contacted, said ejector pin is depressed toward said nut and forces said retention cap off said nut thereby allowing said nut sections to dislodge from said bolt to free said bolt such that said bolt may be withdrawn through said hole to detach said hardware from said casket without opening said casket.

22. A fastener assembly for removably attaching hardware to a wall of a casket comprising:

an elongated externally threaded bolt adapted to project through a hole in the casket wall;

a nut threadably engaging said bolt inside the casket to removably secure the hardware to the casket wall; and an ejector actuatable from outside the casket and operable upon actuation to force said nut off said bolt such that said bolt may be withdrawn through the hole to the outside of the casket to detach the hardware from the casket without opening the casket.

* * * * *

UNITED STATES PATENT AND TRADEMARK OFFICE

CERTIFICATE OF CORRECTION

PATENT NO. : 5,377,395

DATED : January 3, 1995

INVENTOR(S) : Donald R. Maier and John E. Linville

It is certified that error appears in the above-indentified patent and that said Letters Patent is hereby corrected as shown below:

Col. 2, line 56, "without:" should be -- without --.

Col. 3, line 57, "cooperate form" should be -- cooperate to form --.

Col. 4, line 11, "tile bolt" should be -- the bolt --.

Col. 4, line 66, "Front" should be -- From --.

Col. 5, line 10, "cabinet" should be -- casket --.

Col. 7, line 2, "anti" should be -- and --.

Signed and Sealed this

Twelfth Day of September, 1995

*Attest:*

Bruce Lehman

BRUCE LEHMAN

*Attesting Officer*

*Commissioner of Patents and Trademarks*